US009982644B2

(12) United States Patent
Kim

(10) Patent No.: US 9,982,644 B2
(45) Date of Patent: May 29, 2018

(54) FUEL CUT APPARATUS

(71) Applicant: HYUNDAI MOTOR COMPANY, Seoul (KR)

(72) Inventor: Soon Yong Kim, Gwangsan-gu (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 2 days.

(21) Appl. No.: 15/372,295

(22) Filed: Dec. 7, 2016

(65) Prior Publication Data

US 2018/0112641 A1 Apr. 26, 2018

(30) Foreign Application Priority Data

Oct. 24, 2016 (KR) ..... 10-2016-0138715

(51) Int. Cl.
*F02M 55/00* (2006.01)
*F02M 63/02* (2006.01)

(52) U.S. Cl.
CPC ..... *F02M 63/0215* (2013.01); *F02M 55/007* (2013.01)

(58) Field of Classification Search
CPC ..... F16K 31/22; F02M 63/0215; F02M 2041/1494; F02M 55/007; F02M 55/00
See application file for complete search history.

(56) References Cited

U.S. PATENT DOCUMENTS 4,597,369 A 7/1986 Yasuhara
4,989,629 A * 2/1991 Shirakawa ..... B60K 15/03519 137/202

FOREIGN PATENT DOCUMENTS

JP 7-47935 B2 5/1995
KR 10-1612055 B1 4/2016
WO 97/30616 A1 8/1997

OTHER PUBLICATIONS

Office Action dated Feb. 13, 2018 in corresponding Korean Patent Application No. 10-2016-0138715—6 pages.

* cited by examiner

*Primary Examiner* — Jacob Amick
(74) *Attorney, Agent, or Firm* — Knobbe Martens Olson & Bear LLP

(57) ABSTRACT

The present disclosure relates to a fuel cut apparatus capable of improving air ventilation while blocking moisture from being infiltrated thereinto by selectively opening and closing an air vent corresponding to engine starting and engine stopping. The fuel cut apparatus includes: a housing; a motor installed at one side of the housing; a rotor rotated by the motor of the housing; and a cam member rotating in association with rotation of the rotor to switch on/off a contact switch, wherein one side of the housing is provided with an air vent, and the air vent is opened or closed by the cam member.

11 Claims, 8 Drawing Sheets

FUEL CUT APPARATUS

CROSS-REFERENCE TO RELATED APPLICATION

This application is based on and claims the benefit of priority to Korean Patent Application No. 10-2016-0138715, filed on Oct. 24, 2016 in the Korean Intellectual Property Office, the disclosure of which is incorporated herein in its entirety by reference.

TECHNICAL FIELD

The present disclosure relates to a fuel cut apparatus.

BACKGROUND

In a vehicle, an injection pump supplying fuel at a high pressure may be provided so that high-pressure fuel may be injected toward a cylinder of an engine through the injector by the injection pump.

The injection pump as described above may include a pump as a base component, and be composed of a governor, an injection timing control device, a fuel supply pump, and the like. Particularly, the injection pump is provided with a stop lever, a fuel cut apparatus is connected to the stop lever via a link mechanism, and the injection pump may be provided so as to move the stop lever to a supply position and a stop position by driving of the fuel cut apparatus.

The fuel cut apparatus is configured so that when the engine is started, the fuel cut apparatus rotates the stop lever to the supply position to supply fuel, and when the engine is stopped, the fuel cut apparatus rotates the stop lever to the stop position to block the fuel.

The disclosure of this section is to provide background of the invention. Applicant notes that this section may contain information available before this application. However, by providing this section, Applicant does not admit that any information contained in this section constitutes prior art.

SUMMARY

An aspect of the present disclosure provides a fuel cut apparatus capable of improving air ventilation while blocking moisture from being infiltrated thereinto by selectively opening and closing an air vent corresponding to engine starting and engine stopping.

According to an embodiment of the present disclosure, a fuel cut apparatus includes: a housing; a motor installed at one side of the housing; a rotor rotated by the motor of the housing; and a cam member rotating in association with rotation of the rotor to switch on/off a contact switch, wherein one side of the housing is provided with an air vent, and the air vent is opened or closed by the cam member.

A plug may be installed to be movable in the air vent, and the air vent may be opened or closed by movement of the plug.

The plug may be installed to be movable in the air vent in association with rotation of the cam member.

The plug may have a body and a head part formed at one end of the body, wherein the body has a conical structure.

An elastic member may be installed between the air vent and the plug.

A shaft may be connected to the motor, helical teeth may be formed on an outer surface of the shaft, teeth may be formed on an outer surface of the rotor in a circumferential direction, and the helical teeth of the shaft and the teeth of the rotor may be engaged with each other.

The rotor may have one or more stoppers formed on an upper surface thereof, the cam member may have one or more stoppers formed on a bottom surface thereof, and the stopper of the rotor and the stopper of the cam member may be cooperated with each other, such that the cam member may be rotated by rotation of the rotor.

The cam member may have a plurality of cam surfaces having contours different from each other in an outer surface thereof.

The plurality of cam surfaces may have a first cam surface, a second cam surfaces positioned to be opposite to the first cam surface, and a third cam surface positioned between the first and second cam surfaces, wherein the third cam surface is closer to the center of the cam member than the first and second cam surfaces.

The first and second cam surfaces may be formed as curved surfaces, and the third cam surface may be formed as a flat surface.

BRIEF DESCRIPTION OF THE DRAWINGS

The above and other features and advantages of the present disclosure will be more apparent from the following detailed description taken in conjunction with the accompanying drawings.

DETAILED DESCRIPTION

Hereinafter, embodiments of the present invention will be described in detail with reference to the accompanying drawings. For reference, sizes of component, thicknesses of lines, and the like, illustrated in the accompanying drawings referred in the present description may be exaggerated for convenience of understanding. In addition, the following terminologies are defined in consideration of the functions in the present disclosure and may be construed in different ways by the intention of users and operators, customary practices, or the like. Therefore, the definitions of terms used in the present description should be construed based on the contents throughout the specification.

Typically, a fuel cut apparatus is installed in an engine room of a commercial vehicle, and it is highly likely that moisture, or the like, will infiltrate into the fuel cut apparatus to generate corrosion of an internal component.

An air vent ventilating air is provided in one side of a housing of the fuel cut apparatus, and due to the air vent as described above, it is possible to avoid damage, an operation problem, or the like, of the internal component by an internal gas and a high pressure state of the fuel cut apparatus.

However, since a typical fuel cut apparatus is in a state in which a temperature of a surface thereof is high and the inside thereof is expanded under high pressure during the driving, when wash moisture is sprayed on the surface of the fuel cut apparatus at the time of washing the engine room, the inside of the fuel cut apparatus may be contracted, such that there is a pressure difference between the inside and the outside of the fuel cut apparatus, and thus, moisture, or the like, may infiltrate to the inside of the fuel cut apparatus through the air vent, thereby causing damage or an operation problem, or the like, of the internal component.

Therefore, moisture infiltration may be blocked by connecting a hose to the air vent and adjusting a length, a direction, and the like, of the hose in the fuel cut apparatus, but there was no method capable of blocking infiltration of moisture formed at an end portion of the hose, thus an effect of blocking moisture is insufficient.

Figure 1A:
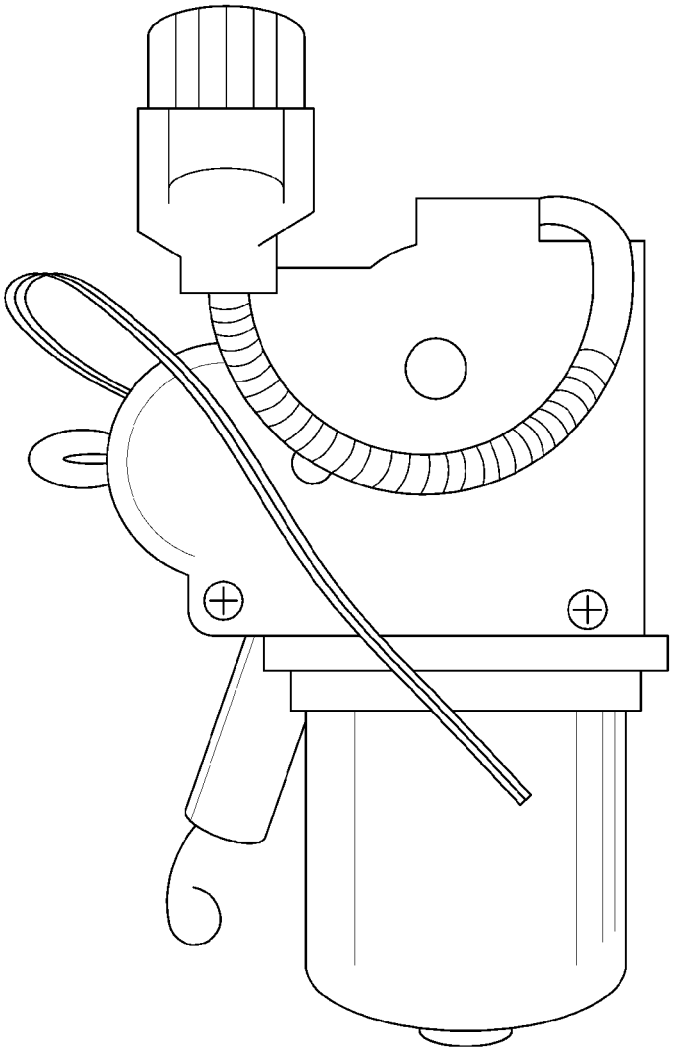
FIG. 1A is a view showing a housing of a fuel cut apparatus.
Figure 1B:
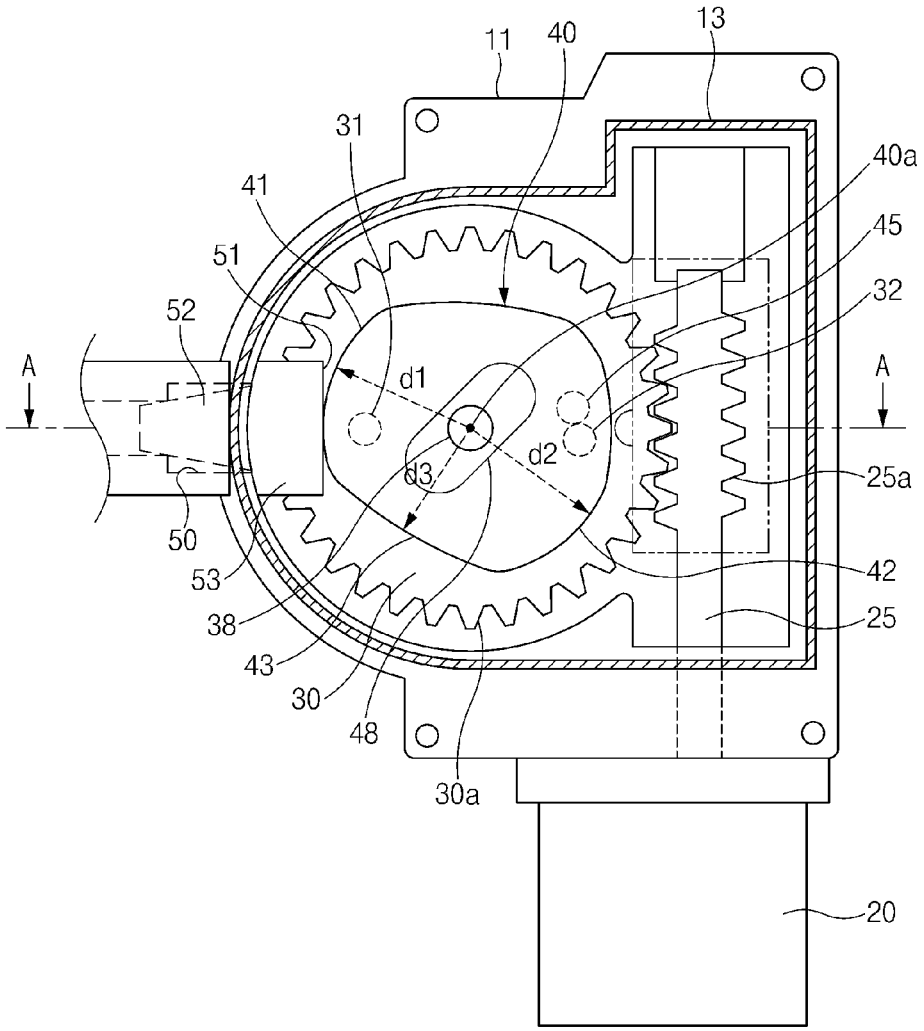
FIG. 1B is a view illustrating a state in which a housing of a fuel cut apparatus according to an embodiment of the present disclosure is partially opened.
Figure 2:
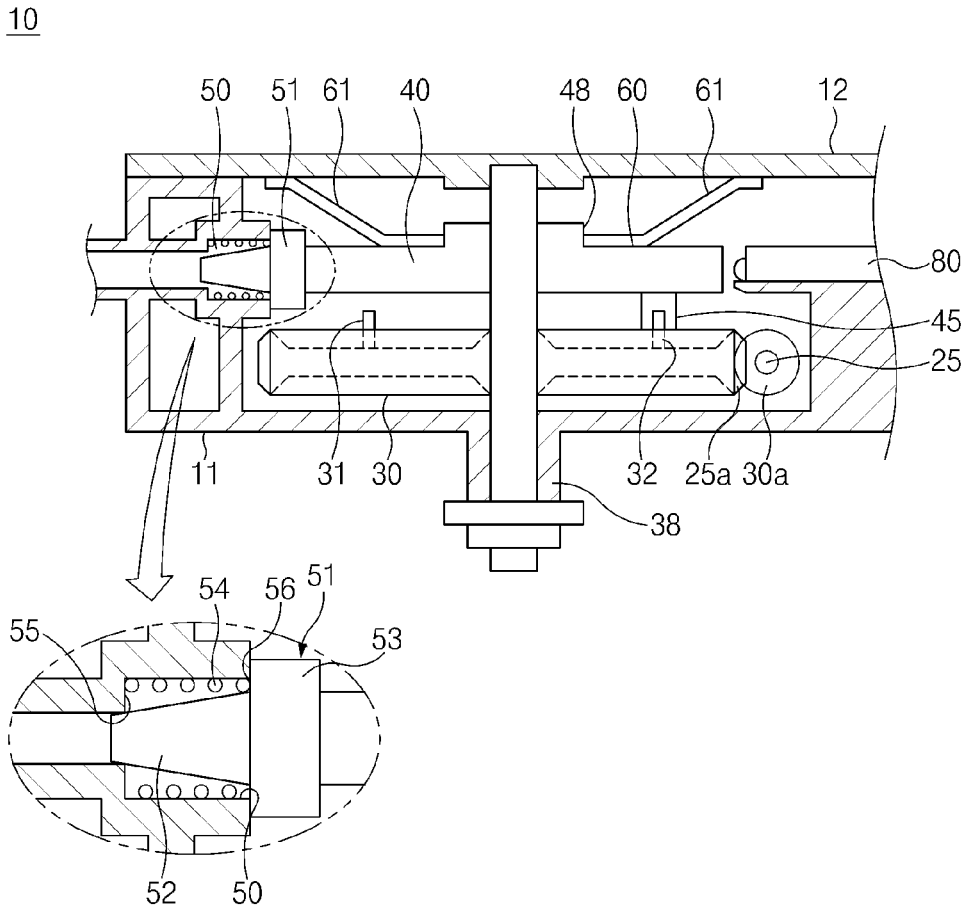
FIG. 2 is a cross-sectional view taken along line A-A' of FIG. 1B.

Referring to FIGS. 1 and 2, a fuel cut apparatus 10 according to an embodiment of the present disclosure may include a housing 11, a motor 20 installed at one side of the housing 11, a rotor 30 rotated by the motor 20 of the housing 11, and a cam member 40 rotating in association with rotation of the rotor 30 to switch on/off a contact switch 80.

Referring to FIG. 1B, one surface of the housing 11 is opened, and the rotor or a worm gear 30, the cam member 40, the contact switch 80, and the like, may be easily assembled through the opened surface of the housing 11 as described above. In addition, as illustrated in FIG. 2, a cover 12 may be installed on the opened surface of the housing 11, thereby making it possible to secure a sealing property of the housing 11. A sealing member 13 is installed at an edge of the housing 11, thereby making it possible to secure a sealing property with respect to an internal space of the housing 11.

Referring to FIG. 2, an air vent 50 may be installed at one side of the housing 11, a plug 51 may be installed to be movable in the air vent 50, and the air vent 50 may be opened or closed by movement of the plug 51.

The plug 51 may have a body 52 and a head part 53 formed at one end of the body 52. The body 52 may be disposed to be movable in an internal path of the air vent 50, and the head part 53 may contact or be spaced apart from an inner end of the air bent 50 by movement of the head part 53.

The body 52 may have a conical structure in which a diameter thereof is decreased in an opposite direction to the head part 53, such that when the air vent 50 is opened, air may be smoothly ventilated by the conical body 52, and when the air vent 50 is closed, a sealing property for an internal space of the housing 11 may be secured by the head part 53.

An elastic member 54 may be installed between the air vent 50 and the plug 51. The elastic member 54 may provide elastic force to the plug 51 in an opening direction of the air vent 50.

A first step 55 may be formed in the air vent 50, and a second step 56 may be formed in the plug 51. The second step 56 may be formed between the body 52 and the head part 53 of the plug 51. Therefore, both ends of the elastic member 54 may be individually supported by the first and second steps 55 and 56.

The motor 20 may be installed at one side of the housing 11, and generate power.

The rotor 30 may be rotatably installed in the housing 11, and be rotated by the power of the motor 20. A rotating shaft 38 may be provided at the center of the rotor 30 and supported so as to be rotatable with respect to the housing 11 and the cover 12.

According to the embodiment of the present disclosure, a shaft 25 is connected to the motor 20, and helical teeth 25*a* are formed on a portion of an outer surface of the shaft or worm screw 25. Teeth 30*a* are formed on an outer surface of the rotor 30 in a circumferential direction, and axes of the shaft 25 and the rotor 30 may intersect each other in a direction perpendicular to each other. For example, as the shaft 25 has the helical teeth 25*a*, the shaft 25 may be a worm screw, and as the rotor 30 has the teeth 30*a*, the rotor 30 may be a worm gear. Therefore, the helical teeth 25*a* of the shaft 25 and the teeth 30*a* of the rotor 30 may be engaged with each other, thereby configuring a worm drive. Power of the motor 20 is transmitted to the rotor 30 by the worm drive as described above, such that the rotor 30 may rotate in a clockwise or counterclockwise direction.

One or more stoppers 31 and 32 may be formed on an upper surface of the rotor 30, and one or more stoppers 31 and 32 may include first and second stoppers 31 and 32 spaced apart from each other. The first and second stoppers 31 and 32 may be spaced apart from each other at a predetermined angle in a circumferential direction of the rotor 30. For example, the first and second stoppers 31 and 32 may be spaced apart from each other by an angle of 180°. In embodiments, such configuration of the stoppers 31 and 32 allow the rotation of the worm gear 30 about 180° without rotating the cam 40.

The rotation shaft 38 of the rotor 30 may penetrate through the center of the cam member 40, such that the cam member 40 may rotate based on the rotation shaft 38 of the rotor 30.

One or more stoppers 45 capable of contacting the stoppers 31 and 32 of the rotor 30 may be installed on a bottom surface of the cam member 40, and any one of the first and second stoppers 31 and 32 of the rotor 30 may push the stopper 45 of the cam member 40 in the clockwise or counterclockwise direction by rotation of the rotor 30, thereby inducing rotation of the cam member 40. For example, as any one of the first and second stoppers 31 and 32 of the rotor 30 is cooperative with the stopper 45 of the cam member 40, the cam member 40 may be rotated by rotation of the rotor 30.

The cam member 40 may have a cam profile which is formed by a plurality of cam surfaces 41 to 43 having contours different from each other in an outer surface thereof, and the plurality of cam surfaces 41 to 43 may include a first cam surface 41, a second cam surface 42, and a third cam surface 43. The first and second cam surfaces 41 and 42 may be positioned to be opposite to each other, and the third cam surface 43 may be positioned between the first and second cam surfaces 41 and 42.

The first to third cam surfaces 41 to 43 may be formed to have various contours. For example, the first and second cam surfaces 41 and 42 may be formed as curved surfaces, and the third cam surface 43 may be formed as a flat surface.

The third cam surface 43 may be positioned to be closer to the center or a rotation axis 40*a* of the cam member 40 than the first and second cam surfaces 41 and 42. In detail, a distance d3 between the third cam surface 43 and the center or the rotation axis 40*a* of the cam member 40 may be shorter than a distance d1 between the first cam surface 41 and the center or the rotation axis 40*a* of the cam member 40 and a distance d2 between the second cam surface 42 and the center or the rotation axis 40*a* of the cam member 40 (d3<d1 and d3<d2).

Figure 4:
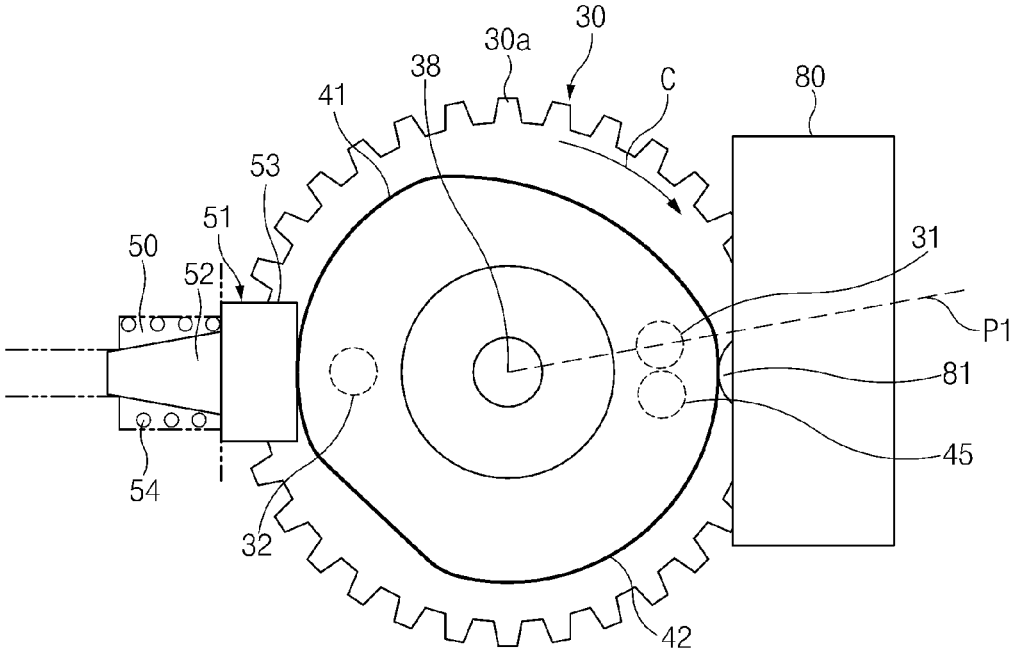
FIG. 4 is a view illustrating a state in which the rotor rotates up to a first position in one direction (a clockwise direction) in the state illustrated in FIG. 3 and thus a first stopper of the rotor and the stopper of the cam member contact each other.
Figure 5:
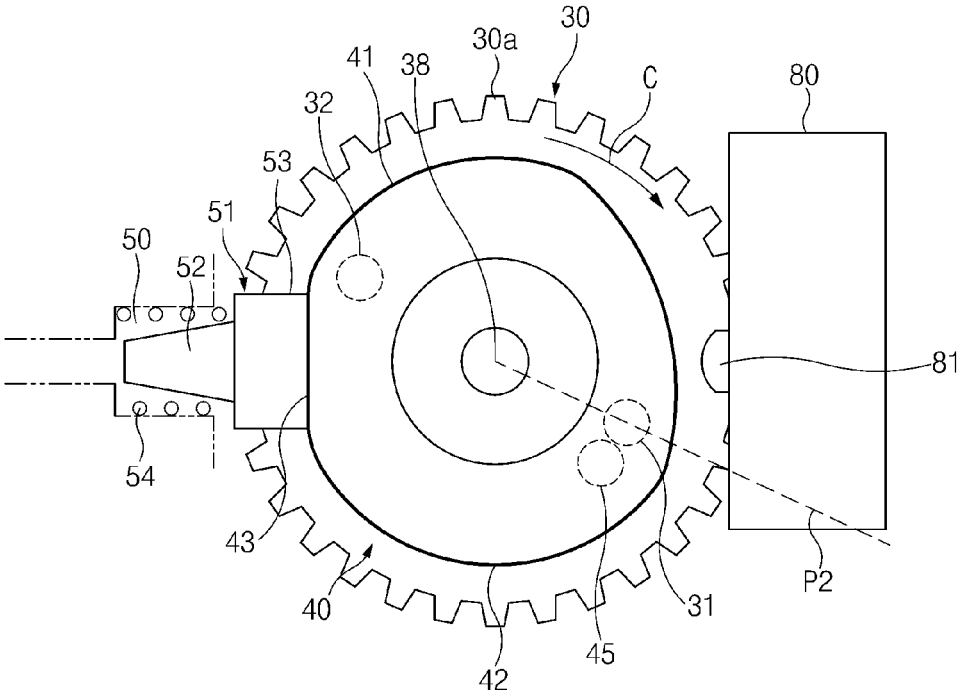
FIG. 5 is a view illustrating a state in which the rotor rotates up to a second position in one direction (the clockwise direction) in the state illustrated in FIG. 4 and thus the first stopper of the rotor pushes the stopper of the cam member to rotate the cam member at a predetermined angle, such that the plug opens the air vent.
Figure 6:
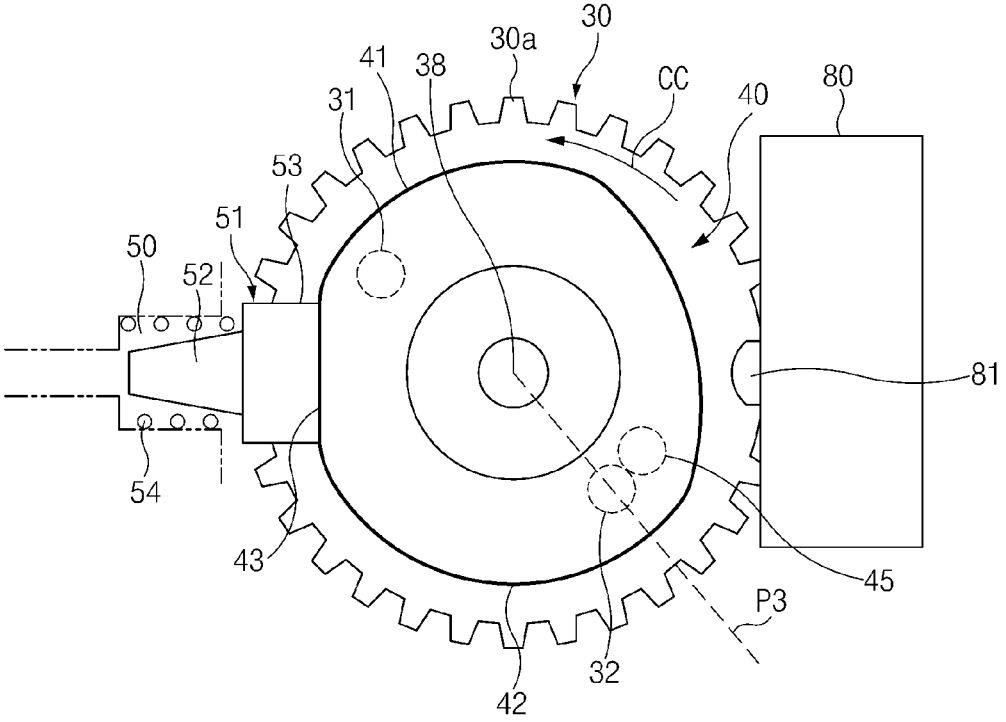
FIG. 6 is a view illustrating a state in which the rotor rotates up to a third position in the other direction (a counterclockwise direction) in the state illustrated in FIG. 5 and thus a second stopper of the rotor and the stopper of the cam member contact each other.

Therefore, in the case in which the first cam surface 41 contacts a back surface of the head part 53 of the plug 51, the plug 51 may close the air vent 50 (see FIGS. 3, 4, and 7), and in the case in which the third cam surface 43 contacts the back surface of the head part 53 of the plug 51, the plug 51 may open the air vent 50 (see FIGS. 5 and 6).

The contact switch 80 may be installed adjacent to the cam member 40, and as the second cam surface 42 of the cam member 40 contacts or is spaced apart from a knob 81 of the contact switch 80 by rotation of the rotor 30, the contact switch 80 may be switched on/off.

When the contact switch 80 is switched off, a link mechanism of the fuel cut apparatus 10 may pull a stop lever of an injection pump, thereby making it possible to supply fuel to an engine.

When the contact switch 80 is switched on, the link mechanism of the fuel cut apparatus 10 releases a pulling operation for the stop lever of the injection pump, thereby making it possible to blocking supply of the fuel to the engine.

A plate spring 60 may be installed on an upper surface of the cam member 40, and an interval between the cam member 40 and the rotor 30 may be constantly maintained by the plate spring 60, thereby making it possible to prevent the cam member 40 from being separated from the rotor 30.

The plate spring 60 may have a plurality of spring legs 61, and end portions of the spring legs 61 may be supported by the cover 12.

A fitting protrusion 48 into which the plate spring 60 is fitted may be formed on the upper surface of the cam member 40.

An operation of the fuel cut apparatus 10 according to the embodiment of the present disclosure will be described in detail with reference to FIGS. 3 to 7.

Figure 3:
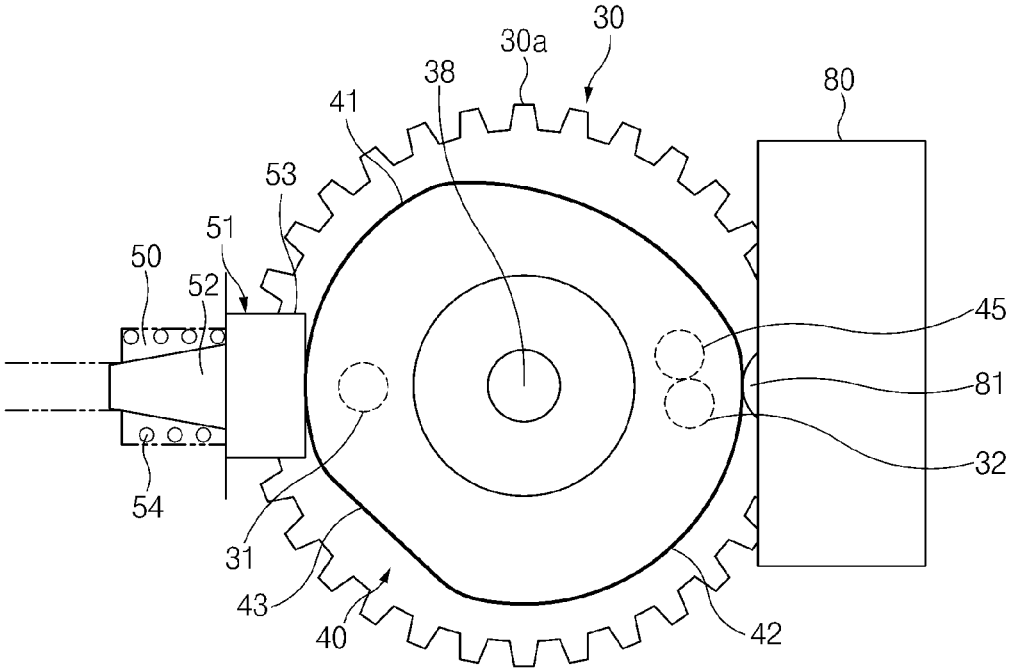
FIG. 3, which is a view illustrating a state in which a plug closes an air vent by a cam member of the fuel cut apparatus according to the embodiment of the present invention, illustrates a state in which a second stopper of a rotor and a stopper of the cam member contact each other.

FIG. 3 illustrates a state in which the air vent 50 is closed by the plug 51 in a state in which the engine is stopped. In this case, the second stopper 32 of the rotor 30 may contact the stopper 45 of the cam member 40, and the first stopper 31 of the rotor 30 may be positioned adjacently to the plug 51. In addition, the first cam surface 41 of the cam member 40 may contact the head part 53 of the plug 51, and thus, the head part 53 of the plug 51 may be closely adhered to the inner end of the air vent 50, thereby making it possible to close the air vent 50. As the second cam surface 42 of the cam member 40 contacts the knob 81 of the contact switch 80, the contact switch 80 is switched on, and the link mechanism connected to the fuel cut apparatus 10 releases the stop lever of the injection pump by a switch-on operation of the contact switch 80 as described above, such that supply of the fuel may be blocked.

Thereafter, when the engine is started, the rotor 30 is rotated by the operation of the motor 20 of the fuel cut apparatus 10 in one direction (see an arrow C direction of FIG. 4) at an angle of about 180° or so, such that the first stopper 31 of the rotor 30 is positioned at a first position P1 as illustrated in FIG. 4, and thus, the first stopper 31 of the rotor 30 may contact the stopper 45 of the cam member 40.

Then, when the rotor 30 rotates in one direction (see an arrow C direction of FIG. 5) at an angle of about 30° to 45° or so, the first stopper 31 of the rotor 30 is positioned at a second position P2 as illustrated in FIG. 5, such that the first stopper 31 of the rotor 30 pushes the stopper 45 of the cam member 40 in one direction (see the arrow C direction of FIG. 5), such that the cam member 40 may be rotated in one direction (see the arrow C direction of FIG. 5). Therefore, the third cam surface 43 of the cam member 40 may be moved to a position at which the third cam surface 43 of the cam member 40 may contact the head part 53 of the plug 51, and at the same time, the plug 51 is moved by elastic force of the elastic member 54, such that the third cam surface 43 of the cam member 40 contacts the back surface of the head part 53 of the plug 51.

As described above, when the engine is started, as the head part 53 of the plug 51 contacts the third cam surface 43 of the cam member 40, the air vent 50 may be opened, and the inside of the housing 11 may be in communication with the outside through the air vent 50 opened as described above.

Thereafter, when the engine is stopped, the rotor 30 is rotated by the motor 20 of the fuel cut apparatus 10 in the other direction (see an arrow CC direction of FIG. 6) at an angle of about 180° or so in a state illustrated in FIG. 5, such that the second stopper 32 of the rotor 30 is positioned at a third position P3 as illustrated in FIG. 6, and thus, the second stopper 32 of the rotor 30 may contact the stopper 45 of the cam member 40.

Figure 7:
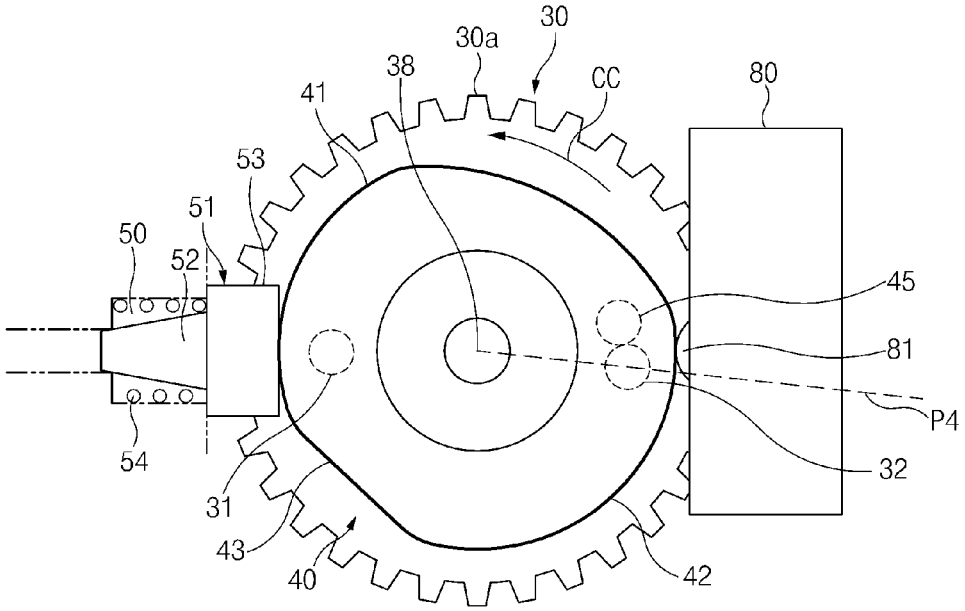
FIG. 7 is a view illustrating a state in which the rotor rotates up to a fourth position in the other direction (the counterclockwise direction) in the state illustrated in FIG. 6 and thus the second stopper of the rotor pushes the stopper of the cam member to rotate the cam member at a predetermined angle, such that the plug closes the air vent.

Then, when the rotor 30 rotates in the other direction (see the arrow CC direction of FIG. 7) at an angle of about 30° to 45° or so, the second stopper 32 of the rotor 30 is positioned at a fourth position P4 as illustrated in FIG. 7, such that the second stopper 32 of the rotor 30 pushes the stopper 45 of the cam member 40 in the other direction (see the arrow CC direction of FIG. 7), such that the cam member 40 may be rotated in the other direction (see the arrow CC direction of FIG. 7). Therefore, the first cam surface 41 of the cam member 40 is moved to a position at which the first cam surface 41 of the cam member 40 may contact the plug 51, such that the first cam surface 41 of the cam member 40 may press the head part 53 of the plug 51 toward the air vent 50, and thus, the plug 51 may close the air vent 50.

Since the plug 51 may close the air vent 50 by the cam member 40 in a state in which the engine is stopped as described above, it is possible to block moisture from being infiltrated into the housing 11.

According to the present disclosure, since a sealing property and air ventilation of the fuel cut apparatus 10 may be secured by configuring the plug 51 so as to selectively open and close the air vent 50 by the cam member 40 in association with the rotor 30 in accordance with starting and stopping of the engine, it is possible to avoid damage, an operation problem, or the like, of internal components.

In embodiments, referring to FIGS. 1-7, the vehicle includes a controller, for example, an ECU, which comprises one or more processors. The controller controls devices in the vehicle for generating a signal for turning on the engine and a signal for turning off the engine, and transmits the signals to other devices including the motor 20.

In embodiments, when the signal for turning off the engine triggers the operation of the motor 20, which subsequently causes the air vent 50 to close and further causes the fuel cut apparatus to stop the fuel supply to the engine. The engine turning-off signal does not directly cause the operation of the link mechanism of the fuel cut apparatus. Rather, the engine turning-off signal indirectly causes the operation of the link mechanism of the fuel cut apparatus via the operation of motor 20 and the cam mechanism 40. The engine turning-off signal is generated, for example, when a driver rotates a key, pushes a start/stop button or presses a brake pedal.

Likewise, in embodiments, the signal for turning on the engine triggers the operation of the motor 20 which subsequently causes the air vent 50 to open and further causes the fuel cut apparatus to start the fuel supply to the engine. The engine turning-on signal does not directly cause the operation of the link mechanism of the fuel cut apparatus. Rather, the engine turning-on signal indirectly causes the operation of the link mechanism of the fuel cut apparatus via the operation of motor 20 and the cam mechanism 40. The engine turning-on signal is generated, for example, when the driver rotates the key, pushes the start/stop button or releases the brake pedal.

In an embodiment, the cam has a cam profile such that the air vent is completely closed before the fuel cut apparatus stops the fuel supply to engine. In another embodiment, the motor 20 further operates even after the fuel cut apparatus stops the fuel supply to the engine to completely close.

As described above, according to the embodiment of the present disclosure, the air vent is selectively opened or closed corresponding to engine starting and engine stopping, thereby making it possible to block moisture, or the like, from being infiltrated into the housing at the time of engine stopping and to allow the inside of the housing and the outside to be smoothly ventilated at the time of engine starting. Therefore, the damage, the operation problem, and the like of the components in the housing may be prevented.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A fuel cut apparatus comprising:

a housing;

a motor installed at one side of the housing;

a rotor configured to be rotated by the motor; and a cam member configured to rotate in association with rotation of the rotor to switch on/off a contact switch, wherein one side of the housing is provided with an air vent, and the air vent is opened or closed by the cam member.

2. The fuel cut apparatus according to claim 1, wherein a plug is installed to be movable in the air vent, and the air vent is opened or closed by movement of the plug.

3. The fuel cut apparatus according to claim 2, wherein the plug is installed to be movable in the air vent by rotation of the cam member.

4. The fuel cut apparatus according to claim 3, wherein the plug has a body and a head part formed at one end of the body, the body having a conical structure.

5. The fuel cut apparatus according to claim 4, wherein an elastic member is installed between the air vent and the plug.

6. The fuel cut apparatus according to claim 1, wherein a shaft is connected to the motor, helical teeth are formed on an outer surface of the shaft, teeth are formed on an outer surface of the rotor in a circumferential direction, and the helical teeth of the shaft and the teeth of the rotor are engaged with each other.

7. The fuel cut apparatus according to claim 6, wherein the rotor has one or more stoppers formed on an upper surface thereof, the cam member has one or more stoppers formed on a bottom surface thereof, and the stoppers of the rotor and the cam member are cooperated with each other, such that the cam member is rotated by rotation of the rotor.

8. The fuel cut apparatus according to claim 1, wherein the cam member has a plurality of cam surfaces having contours different from each other in an outer surface thereof.

9. The fuel cut apparatus according to claim 8, wherein the plurality of cam surfaces have a first cam surface, a second cam surfaces positioned to be opposite to the first cam surface, and a third cam surface positioned between the first and second cam surfaces, the third cam surface being closer to the center of the cam member than the first and second cam surfaces.

10. The fuel cut apparatus according to claim 9, wherein the first and second cam surfaces are formed as curved surfaces, and the third cam surface is formed as a flat surface.

11. The fuel cut apparatus according to claim 1, wherein a stop lever of an engine injection pump is configured to be rotated by rotation of a link connected to the motor to start or stop supplying fuel when the engine is switched on or off.

* * * * *